US007544931B2

(12) United States Patent
Yamaguchi et al.

(10) Patent No.: US 7,544,931 B2
(45) Date of Patent: Jun. 9, 2009

(54) MASS-ANALYZING METHOD

(75) Inventors: Shinichi Yamaguchi, Kyoto (JP); Yusuke Inohana, Kyoto (JP)

(73) Assignee: Shimadzu Corporation, Kyoto (JP)

( * ) Notice: Subject to any disclaimer, the term of this patent is extended or adjusted under 35 U.S.C. 154(b) by 268 days.

(21) Appl. No.: 11/718,365

(22) PCT Filed: Oct. 26, 2005

(86) PCT No.: PCT/JP2005/019728

§ 371 (c)(1),
(2), (4) Date: May 1, 2007

(87) PCT Pub. No.: WO2006/049064

PCT Pub. Date: May 11, 2006

(65) Prior Publication Data

US 2008/0121793 A1 May 29, 2008

(30) Foreign Application Priority Data

Nov. 2, 2004 (JP) ..... 2004-318642
Sep. 28, 2005 (JP) ..... 2005-282981

(51) Int. Cl.
*H01J 49/00* (2006.01)

(52) U.S. Cl. ..... 250/282; 250/288; 250/283; 250/281; 422/68.1; 702/27; 702/23; 702/22

(58) Field of Classification Search ..... 250/281, 250/282, 283, 288; 422/68.1; 702/22, 23, 702/27

See application file for complete search history.

(56) References Cited

U.S. PATENT DOCUMENTS 6,745,134 B2 6/2004 Kobayashi et al.
6,787,767 B2 * 9/2004 Kato ..... 250/292
7,429,727 B2 * 9/2008 Bern ..... 250/282
2003/0108876 A1 * 6/2003 Speir ..... 435/6
2004/0169138 A1 9/2004 Ootake et al.
2006/0085142 A1 * 4/2006 Mistrik ..... 702/27
2006/0255263 A1 * 11/2006 Ishimaru et al. ..... 250/288
2008/0073501 A1 * 3/2008 Yamaguchi et al. ..... 250/282

FOREIGN PATENT DOCUMENTS

JP 8-124519 A 5/1996

(Continued)

OTHER PUBLICATIONS

International Search Report of PCT/JP2005/019728, date of mailing Jan. 24, 2006.

*Primary Examiner*—David A Vanore
*Assistant Examiner*—Michael J Logie
(74) *Attorney, Agent, or Firm*—Westerman, Hattori, Daniels & Adrian, LLP.

(57) ABSTRACT

In a mass analysis of a sample, candidate compositions Y of a fragment ion produced by a dissociating operation are deduced from the mass of that fragment ion (Steps S6 to S9). If the number of the candidates Y is larger than a predetermined value ("No" in Step S10), the repetition counter of the dissociating operation is increased by one and the mass analysis of the fragment ion is performed again. If the number of the candidates is equal to or smaller than the predetermined value, the difference between the masses of the fragment ions before and after each mass-analyzing stage is calculated (Step S11). From this mass difference, the candidates Z of the desorption ion at each stage is deduced (Step S12). These candidates Z and Y are used to narrow down the candidate composition formulae X deduced from the mass of the precursor ion (Step S13). If the number of the candidates has decreased to one or become equal to or smaller than a predetermined value, the result is displayed (Steps S14 and S15). Thus reducing the number of the candidates to the lowest possible value, the present method provides the user with useful information for analyzing the molecular structure and/or composition of a sample having a large molecular weight.

7 Claims, 5 Drawing Sheets

FOREIGN PATENT DOCUMENTS

| | | | |
|---|---|---|---|
| JP | 10-142196 | A | 5/1998 |
| JP | 11-64285 | A | 3/1999 |
| JP | 2001-249114 | A | 9/2001 |
| JP | 2002-505443 | A | 2/2002 |
| JP | 2004-28782 | A | 1/2004 |
| JP | 2004-257922 | A | 9/2004 |
| WO | 9945150 | A1 | 9/1999 |

* cited by examiner

MASS-ANALYZING METHOD

TECHNICAL FIELD

The present invention relates to a mass-analyzing method using a mass spectrometer. More specifically, it relates to a mass-analyzing method using a mass spectrometer capable of analyzing fragment ions created by dissociating an ion to be analyzed. Such a method is particularly used for analyzing the composition or structure of a molecule.

BACKGROUND ART

An MS/MS analysis (or tandem analysis) is a type of mass-analyzing method using an ion trap mass spectrometer or similar apparatuses. In a typical MS/MS analysis, an ion having a specific mass (m/z) is first separated from the material to be analyzed. This ion is called the parent ion, or the precursor ion. Next, the precursor ion thus separated is broken into fragment ions by a collision-induced dissociation (CID) process. Finally, the fragment ions (called the "fragment ions" hereinafter) produced by the dissociation process are subjected to a mass-analyzing process to obtain information about the mass or chemical structure of the ion concerned.

In recent years, such apparatuses have been often used to analyze samples having larger molecular weights and more complex structures (or compositions) than before. Some samples having special characteristics cannot be broken into ions having adequately small weights by a single dissociating step. One method for dealing with such a case is called the $MS^n$ analysis, in which the dissociating operation is repeated multiple (n−1) times and the fragment ions finally produced are subjected to a mass-analyzing process (for example refer to Patent Documents 1 and 2). If, as in the previous case, the dissociating operation is performed just once, the mass analysis of the fragment ions can be called the $MS^2$ analysis.

In the $MS^n$ analysis, candidates for the molecular structure or composition of the original sample are narrowed down on the basis of two kinds of information: a composition formula expressed by a combination of the elements estimated from the mass of the precursor ion; and a combination of the elements estimated from the mass of the fragment ions. In this case, even an apparatus capable of calculating masses with a considerable level of accuracy will encounter a larger number of candidates as the molecular weight becomes larger. Then, it will be very difficult to finally determine the composition of the sample concerned.

[Patent Document 1] Japanese Unexamined Patent Application Publication No. H10-142196

[Patent Document 2] Japanese Unexamined Patent Application Publication No. 2001-249114

DISCLOSURE OF THE INVENTION

Problem to be Solved by the Invention

To solve the above-described problem, the present invention intends to provide a mass-analyzing method for easily and accurately analyzing the molecular structure and/or composition of a sample having a particularly large molecular weight.

Means for Solving the Problems

Thus, in a mass-analyzing method for analyzing the molecular structure and/or composition of a sample, using a mass spectrometer capable of an $MS^n$ analysis in which a precursor ion originating from a sample to be analyzed is dissociated into fragment ions by (n−1) steps (where n≧3) and then the fragment ions are subjected to a mass-analyzing process, the mass-analyzing method according to the first mode of the present invention includes:

a) a candidate X deduction step for deducing candidates X of the component corresponding to the precursor ion obtained by an $MS^1$ analysis in which no dissociating operation is performed, on the basis of the mass of the precursor ion;

b) a candidate Y deduction step for deducing candidates Y of the component corresponding to the fragment ion obtained by an $MS^m$ analysis (where 2≦m≦n), on the basis of the mass of that fragment ion;

c) a candidate Z deduction step to be performed when the number of the candidates Y is equal to or smaller than a predetermined value, where the step includes the sub-steps of calculating the difference between the mass of the fragment ion obtained by an $MS^p$ analysis (for p=2 to m) and the mass of a precursor or fragment ion obtained by an $MS^{p-1}$ analysis and then deducing candidates Z of the component corresponding to the aforementioned difference in mass; and d) a narrowing step for narrowing down the candidates X by using at least the candidates Y and Z, and the number m is increased step by step from 2 up to n until the number of the candidates X becomes equal to one, or equal to or smaller than a predetermined value.

In a mass-analyzing method for analyzing the molecular structure and/or composition of a sample, using a mass spectrometer capable of an $MS^n$ analysis in which a precursor ion originating from a sample to be analyzed is dissociated into fragment ions by (n−1) steps (where n≧2) and then the fragment ions are subjected to a mass-analyzing process, the mass-analyzing method according to the second mode of the present invention includes:

a) a step for deducing candidate compositions X of the component corresponding to a precursor or fragment ion obtained by an $MS^m$ analysis (where 1≦m≦n−1), on the basis of the mass of the precursor or fragment ion;

b) a candidate Y deduction step for deducing candidates Y of the component corresponding to the fragment ion obtained by an $MS^p$ analysis (where p≧m+1) in which the aforementioned precursor or fragment ion is dissociated once or multiple times, on the basis of the mass of the fragment ion;

c) a candidate Z deduction step including the sub-steps of calculating the difference between the mass of the fragment ion obtained by an $MS^q$ analysis (for q=m+1 to p) and the mass of the precursor or fragment ion obtained by an $MS^{q-1}$ analysis and then deducing candidates Z of the component corresponding to the aforementioned difference in the mass;

d) a candidate Y+Z creation step for creating compound candidates Y+Z, each of which consists of one candidate Y combined with one candidate Z; and e) a narrowing step for narrowing down the candidates X by comparing the candidates X and the compound candidates Y+Z.

In a mass-analyzing method for analyzing the molecular structure and/or composition of a sample, using a mass spectrometer capable of an $MS^n$ analysis in which a precursor ion originating from a sample to be analyzed is dissociated into fragment ions by (n−1) steps (where n≧2) and then the fragment ions are subjected to a mass-analyzing process, the mass-analyzing method according to the third mode of the present invention includes:

a) an analysis condition table creation step for creating an analysis condition table showing the maximum and minimum numbers of each kind of atoms that can be contained in the precursor ion;

b) a candidate Y deduction step for deducing candidates Y of the component corresponding to the fragment ion obtained by an $MS^m$ analysis (where $2 \leqq m \leqq n$), on the basis of the mass of that fragment ion;

c) a candidate Z deduction step including the sub-steps of calculating the difference between the mass of an ion obtained by an $MS^{m-1}$ analysis, which ion corresponds to the precursor ion for a fragment ion, and the mass of that fragment ion, and then deducing candidates Z of the component corresponding to the aforementioned difference in the mass;

d) an analysis condition revision step A for increasing the minimum number of each kind of atoms shown in the analysis condition table, taking into account the minimum number of each kind of atoms contained in the candidates Y and Z; and e) a candidate X deduction step for deducing the candidates of the component corresponding to the aforementioned precursor ion, on the basis of the mass of the precursor ion, where, in the candidate X deduction step, the candidates X are deduced under analysis conditions using the maximum and minimum numbers of each kind of atoms shown in the analysis condition table revised in the analysis condition revision step A.

EFFECT OF THE INVENTION

In the mass-analyzing method according to the first mode of the present invention, the mass of a precursor ion originating from the sample to be analyzed is measured by an $MS^1$ analysis, in which no dissociating operation is performed. Then, the candidate X deduction step is carried out to list the candidates X of the component (or composition) of the precursor ion (i.e. the original sample), taking into account several conditions including the mass accuracy of the mass spectrometer used and the kinds of atoms that can be components of the sample and the maximum number of each kind of atoms. If the mass spectrometer has a very high level of mass accuracy, it will be easy to narrow down the candidates X of the component of the precursor ion. However, in many cases, the mass accuracy is not so high that there will be a large number of candidates X listed. Accordingly, in the next step, with the parameter n changed to 2, an $MS^2$ analysis is carried out, in which the dissociating operation is performed just once, and the mass of the fragment ion is measured. Then, in the candidate Y deduction step, candidates Y of the component of the fragment ion are listed on the basis of the mass of the fragment ion.

The mass of the fragment ion created by dissociating the precursor ion is naturally smaller than that of the precursor ion. However, if the original sample has a large molecular weight, it is difficult to obtain an adequately small number of the candidates Y until the mass of the fragment ion becomes much smaller than that of the precursor ion. If there are a large number of candidates Y for the fragment ion, it is difficult to narrow down candidates X for the precursor ion. These considerations suggest that it will be possible to considerably narrow down the candidates Y by increasing the value of m to 4, 5 and so on until a fragment ion having an adequately small mass is obtained. Accordingly, the value of m (i.e. the repetition count of the dissociating operation) is increased step by step until the number of the candidates Y for the fragment ion becomes equal to or smaller than a predetermined value. When the number of the candidates Y for the fragment ion has become equal to or smaller than the predetermined value, the candidate Z deduction step is carried out to list candidates Z for the desorption ion resulting from the dissociation, followed by the narrowing step in which candidates X are narrowed down by using information about the candidates Y and Z. When the number of the candidates X for the precursor ion has been reduced to one or some other value equal to or smaller than a predetermined value, the analysis is discontinued and the candidates X thereby obtained are shown to the user.

When m is at a certain value, carrying out the candidate Z deduction step and the narrowing step will be practically meaningless if the number of the candidates Y obtained in the candidate Y deduction step is still larger than the aforementioned predetermined value; in that case it would be least possible to list candidates X. Therefore, if the number of the candidates Y in the candidate Y deduction step is larger than the predetermined value, it is preferable to increase the value of m and then carry out the candidate Y deduction step without performing the candidate Z deduction step and the narrowing step. This method eliminates unnecessary operations and promptly provides analysis results.

Thus, the mass-analyzing method according to the present invention can quickly and assuredly provide users with information useful for estimating the molecular structure and/or composition of a sample even if the sample has a large molecular weight.

The mass-analyzing method according to the second mode of the present invention is a method for selecting candidate compositions X of a target ion, using candidates Y and Z, i.e. candidate compositions of the fragment ion and the desorption ion produced by dissociating the target ion once or multiple times.

First, in the candidate X deduction step, candidates X of the component corresponding to the ion concerned are deduced on the basis of the mass of the target ion under the predetermined analysis conditions mentioned earlier. The target ion may be either a precursor ion produced by an $MS^1$ analysis of a sample in which no dissociating operation is performed, or a fragment ion produced by dissociating the precursor ion once or multiple times. Next, the candidate Y deduction step is carried out to deduce candidates Y of the composition formula on the basis of the mass of the fragment ion produced by dissociating the target ion once or multiple times. Subsequently, in the candidate Z deduction step, the difference between the masses of the ions before and after the one-time or each of the multiple dissociating operations performed to produce the aforementioned fragment ion from the target ion. Then, candidates Z for the desorption ion produced by each dissociating operation are deduced on the basis of the difference in the mass.

Next, the candidate Y+Z creation step is carried out to create candidates Y+Z by combining all the candidate compositions included in the candidates Y and all the candidate compositions included in the candidates Z. Then, in the narrowing step, the candidates Y+Z are compared with the candidates X to narrow down the candidates X.

Thus, in the mass-analyzing method according to the second mode of the present invention, if a large number of candidates X are found, those candidates which are regarded as impossible to exist from the combinations of the candidates Y and Z can be excluded from consideration. Therefore, it is easy to determine the composition formula of the measured substance by mass analysis.

The process of calculating the candidates of the composition formula of an ion from its mass is performed under analysis conditions including the mass accuracy of the mass spectrometer, the kinds of atoms that can be components of the precursor ion (i.e. the original sample) and the maximum number of each kind of atoms. If these conditions have a wide variety of options, there will be a large number of candidates X to be listed. To avoid this problem, the mass-analyzing method according to the third mode of the present invention restricts the analysis conditions during the estimation of the composition of the precursor ion by using the analysis results of the fragment ion and the desorption ion produced by the dissociating operation.

First, in the analysis condition table creation step, an analysis condition table is created; this table shows the kinds of atoms that can be components of the precursor ion and the maximum and minimum numbers of each kind of atoms. Next, an $MS^n$ analysis is performed on a target sample by dissociating the sample once or multiple times and creating a mass spectrum at each dissociating stage. Subsequently, the candidate Y deduction step is carried out to calculate candidates Y of the composition formula of the component corresponding to the fragment ion obtained by an $MS^m$ analysis (where $2 \leqq m \leqq n$), on the basis of the mass of the fragment ion. The candidate Z deduction step is also performed to deduce candidates Z of the desorption ion produced by the dissociation. In the present calculation, it is preferable that the analysis conditions include the maximum number of each kind of atoms and other information shown in the analysis condition table. In the estimation of the composition of the candidates Z of the desorption ion, it is preferable to further restrict the analysis conditions by subtracting the minimum number of each kind of atoms contained in the candidates Y of the fragment ion from the maximum number of each kind of atoms shown in the analysis condition table. This operation reduces the number of the candidates Z of the desorption ion in the candidate Z deduction step and thereby improves the analysis efficiency.

Conversely, it is also possible to restrict the analysis conditions of the candidate Y deduction step by using the analysis result of the candidate Z deduction step. In that case, the candidate Z deduction step is carried out under the analysis conditions including the maximum number of each kind of atoms shown in the analysis condition table. Then, the analysis conditions are restricted by subtracting the minimum number of each kind of atoms contained in the candidates Z of the desorption ion obtained in the candidate Z deduction step from the maximum number of each kind of atoms shown in the analysis condition table. The analysis conditions thus restricted are used in the following step of deducing the candidates Y. As a result, the number of the candidates Y of the fragment ion in the candidate Y deduction step will be reduced.

From the candidates Y and Z thus deduced, it is possible to determine the minimum number of each element contained in the fragment ion and the minimum number of each element contained in the desorption ion. The number of each kind of atoms contained in the precursor ion of the fragment ion, i.e. the fragment or precursor ion created in the $MS^{m-1}$ analysis, must be equal to or larger than the sum of the minimum numbers of each element contained in the fragment ion and the desorption ion obtained by the $MS^m$ analysis. Accordingly, in the analysis condition revision step A, the analysis condition table is updated with the aforementioned sum as the minimum number of each kind of atoms that can be contained in the precursor ion. Then, the candidate X deduction step is carried out to calculate the candidate compositions of the fragment or precursor ion obtained in the $MS^{m-1}$ analysis, i.e. an ion that corresponds to the precursor ion for the aforementioned fragment ion and the desorption ion, taking into account the minimum and maximum numbers of each kind of atoms shown in the revised analysis condition table. The restriction on the analysis conditions reduces the number of the candidate compositions X of the precursor ion. Thus, the mass-analyzing method according to the third mode of the present invention realizes a very efficient and accurate compositional analysis.

EXPLANATION OF NUMERALS

1 . . . Ion Source
2 . . . Ion Trap
21 . . . Ring Electrode
22, 23 . . . End Cap Electrodes
24 . . . Ion-Trapping Space
25 . . . Entrance
26 . . . Exit
27 . . . Voltage Generator
28 . . . Gas Supply
3 . . . Time Of Flight Mass Spectrometer (TOFMS)
31 . . . Flight Space
32 . . . Detector
4 . . . Controller
5 . . . Data Processor
6 . . . Database
7 . . . Condition Data Storage Unit

BEST MODE FOR CARRYING OUT THE INVENTION

An embodiment of the mass spectrometer, which carries out an analysis by a mass-analyzing method according to the present invention, is described with reference to the drawings.

Figure 1:
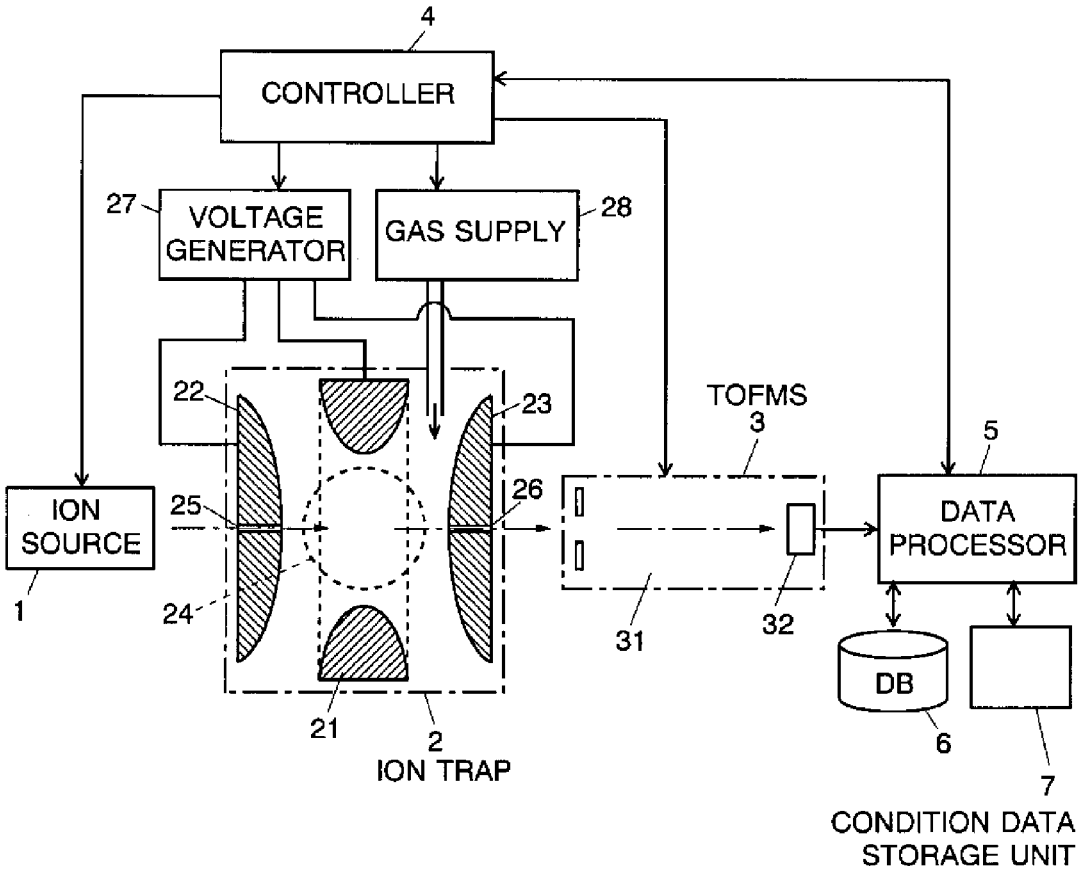
FIG. 1 is a schematic diagram of a mass spectrometer according to an embodiment of the present invention.

FIG. 1 is a schematic diagram of the mass spectrometer of the present embodiment. In FIG. 1, the ion source 1, ion trap 2, and time of flight mass spectrometer (TOFMS) 3 are contained in a vacuum chamber (not shown). The ion trap 2 consists of a pair of end cap electrodes 22 and 23 facing each other across a ring electrode 21. The voltage generator 27 applies a radio-frequency high-voltage to the ring electrode 21 to create a quadrupole electric field within the space surrounded by the ring electrode 21 and the pair of the end cap electrodes 22 and 23. Thus, an ion-trapping space 24 for capturing ions is created within the space. The voltage generator 27 also applies an appropriate auxiliary AC voltage between the end cap electrodes 22 and 23 according to the analysis mode selected at the moment. To help the dissociation of the ions captured in the ion-trapping space 24, a CID gas can be introduced from the gas supply 28 into the ion trap 2. The ion source 1, TOFMS 3, voltage generator 27, gas supply 28 and other components operate under the command of the controller 4 having a central processing unit (CPU) as its main component.

In the mass spectrometer having the above construction, the ion source 1 ionizes the target sample and supplies the resultant ions through the entrance 25 into the ion trap 2. Within the ion trap 2, the ions are temporarily captured in the ion-trapping space 24 by the electric field created by the ring electrode 21 and the end cap electrodes 22 and 23. Subsequently, the CID gas is introduced from the gas supply 28 into the ion trap 2 in order to help the dissociation of the ions by causing them to collide with the gas molecules. After the ions are adequately dissociated, the voltages applied to the electrodes 21, 22 and 23 are changed to create an electric field that forces the ions to move through the exit 26 into the ion trap 2. After leaving the ion trap 2, each ion travels through the flight space 31 of the TOFMS 3 and reaches the detector 32 in a flight time depending on its mass. Receiving these ions one after another, the detector 32 produces a detection signal indicative of the amount of each ion. The detection signal is sent to the data processor 5, which creates a mass spectrum and performs an analysis for estimating the molecular structure and/or composition of the target sample on the basis of the mass of each peak present in the mass spectrum, referring to the data library stored in the database 6.

This analysis process significantly characterizes the mass spectrometer of the present embodiment. The following section describes an example of the analysis steps with reference to the flow chart of FIG. 2.

When the analysis is started in response to an instruction from the user, a normal ($MS^1$) mass analysis, which does not perform the dissociating operation within the ion trap 2, is carried out under the command of the controller 4 (Step S1). First, ions produced by the ion source 1 are temporarily captured in the ion trap 2. Then, without any CID gas being introduced into the ion trap 2, the ions are ejected with a predetermined timing through the exit 26 into the TOFMS 3, which carries out mass analysis to collect mass data (Step S2). The data processor 5 creates a mass spectrum from the mass data, checks all the peaks in the mass spectrum for the peak of an ion originating from the target sample (i.e. the precursor ion), and calculates the mass P of that peak (Step S3).

Next, the data processor 5 calculates candidates X of the composition formula from the mass P of the precursor ion under predetermined analysis conditions, referring to the database 6 (Step S4). The analysis conditions include, for example, the kinds of atoms (or elements) that can be components of the sample, the maximum number of each of those atoms (or elements), and the mass accuracy of the mass spectrometry. The selection of the aforementioned atoms depends on the type of the sample. These analysis conditions, which are determined according to the kind of the target sample and other factors, help to some extent the reduction of the number of the candidates. However, too strict a setting of the analysis conditions will possibly allow the actual composition formula to escape from the candidates. Therefore, it is necessary to somewhat loosen the analysis conditions. As a result, particularly if the molecular weight of the target sample is large, it often happens that there are too many candidates deduced from the mass of the precursor ion.

Therefore, under the command of the controller 4, an $MS^n$ analysis is carried out, with the analysis repetition counter n set to 2 (Steps S5 and S6). In this analysis, the same sample as used in the previous $MS^1$ analysis is ionized in the ion source 1 and then introduced into the ion trap 2. Then, within the ion trap 2, the dissociating operation is performed once and the fragment ions resulting from the dissociation are sent into the TOFMS 3 for mass analysis ($MS^2$ analysis). Using the mass data of the fragment ion produced by the $MS^2$ analysis, the data processor 5 creates a mass spectrum and checks all the peaks in the mass spectrum for a peak of the fragment ion and calculates its mass $d_{n-1}$ (Steps S7, S8). Subsequently, referring to the database 6, the data processor calculates candidates Y of the composition formula of the fragment ion from the mass $d_{n-1}$, under predetermined analysis conditions (Step S9). Typically, the analysis conditions hereby used are the same as used in the previous calculation performed for the precursor ion. However, it is allowable to appropriately change the analysis condition, using some knowledge obtained through the previous analysis results.

Next, it is checked whether the number of the candidates Y is equal to or smaller than a predetermined value (Step S10). If it is larger than the predetermined value, the process goes to Step S16, which is to be described later. If the number is equal to or smaller than the predetermined value, the difference $f_m$ between the masses computed before and after the previous analysis is calculated (Steps S11); for example, if n=2, the difference $f_1$ between the mass P of the precursor ion obtained by the $MS^1$ analysis and the mass $d_1$ of the fragment ion obtained by the $MS^2$ analysis is calculated. Then, with reference to the database 6, the candidates Z of the composition formula of the desorption ion corresponding to the mass difference $f_1$ are calculated under predetermined analysis conditions (Step S12). Subsequently, the candidates X of the composition formula of the precursor ion are narrowed down by a predetermined algorithm using the aforementioned candidates Y and Z of the composition formula (Step S13). Then, it is checked whether the number of the candidates has decreased to one or become equal to or smaller than a predetermined value (Step S14). This "predetermined value" can be set at a desired value. However, in order to provide users with appropriately usable information, the value should not be too large; usually, it should be two or three. If it is determined that the number of the candidates has been adequately small in Step S14, the result is displayed on the screen or similar device (Step S15).

In Step S14, if the number of the candidates has not decreased to one or become equal to or smaller than the predetermined value, the analysis repetition counter n is incremented (Step S16) and the process returns to Step S6. Similarly, if the number of the candidates Y is larger than the predetermined value in Step S10, the process returns through S16 to Step S6. Now, in Step S6, under the command of the controller 4, the repetition count of the dissociating operation to be performed in the ion trap 2 is increased; for example, if n=3, the dissociating operation is performed twice, followed by the mass analysis of the fragment ions produced by the dissociating operations. Subsequently, the process follows the already explained steps.

In the case where the sample has a large molecular weight, while the count of the dissociating operation is small, it is difficult to adequately reduce the number of the candidates of the composition formula obtained on the basis of the mass of the fragment ion originating from the sample. As the count of the dissociating operation increases, the mass of the resultant fragment ion will be considerably small and it will be easy to narrow down the candidates. Therefore, the possibility of "Yes" in Step S10 will be higher. Meanwhile, the number of the desorption ions obtained on the basis of the mass difference $f_m$ also increases, so that there will be more data available for narrowing down the candidates of the composition formula of the precursor ion. Thus, it will be easier to reduce the number of the candidates X of the composition formula of the precursor ion. In summary, according to the present method, even if the sample has a large molecular weight, it is highly possible to select only one candidate of the composition formula or a small number of candidates that the user can easily appreciate, through the process of increasing the count of the dissociating operation.

To narrow down the candidates X of the composition formula of the precursor ion by using the candidates Y of the composition formula of the fragment ion and the candidates Z of the composition formula of the desorption ion, it is possible to use the following method:

All the possible pairs of the candidate composition formulae included in the candidates Y of the fragment ion obtained in Step S9 and the candidate composition formulae included in the candidates Z of the desorption ion obtained in Step S12 are created as compound candidates Y+Z. Then, the candidates Y+Z are compared with the candidate compositions X of the precursor ion obtained in Step S4 and those candidates which are commonly found in both candidate groups Y+Z and X are selected as a new, reduced set of candidates X. Thus, even if the candidates X of the precursor ion include a large number of candidate compositions, it is possible to present the user a reliable set of candidate composition formulae by excluding some candidates that can be regarded as disqualified from the combinations of the candidates Y of the fragment ion and the candidates Z of the desorption ion.

Figure 3:
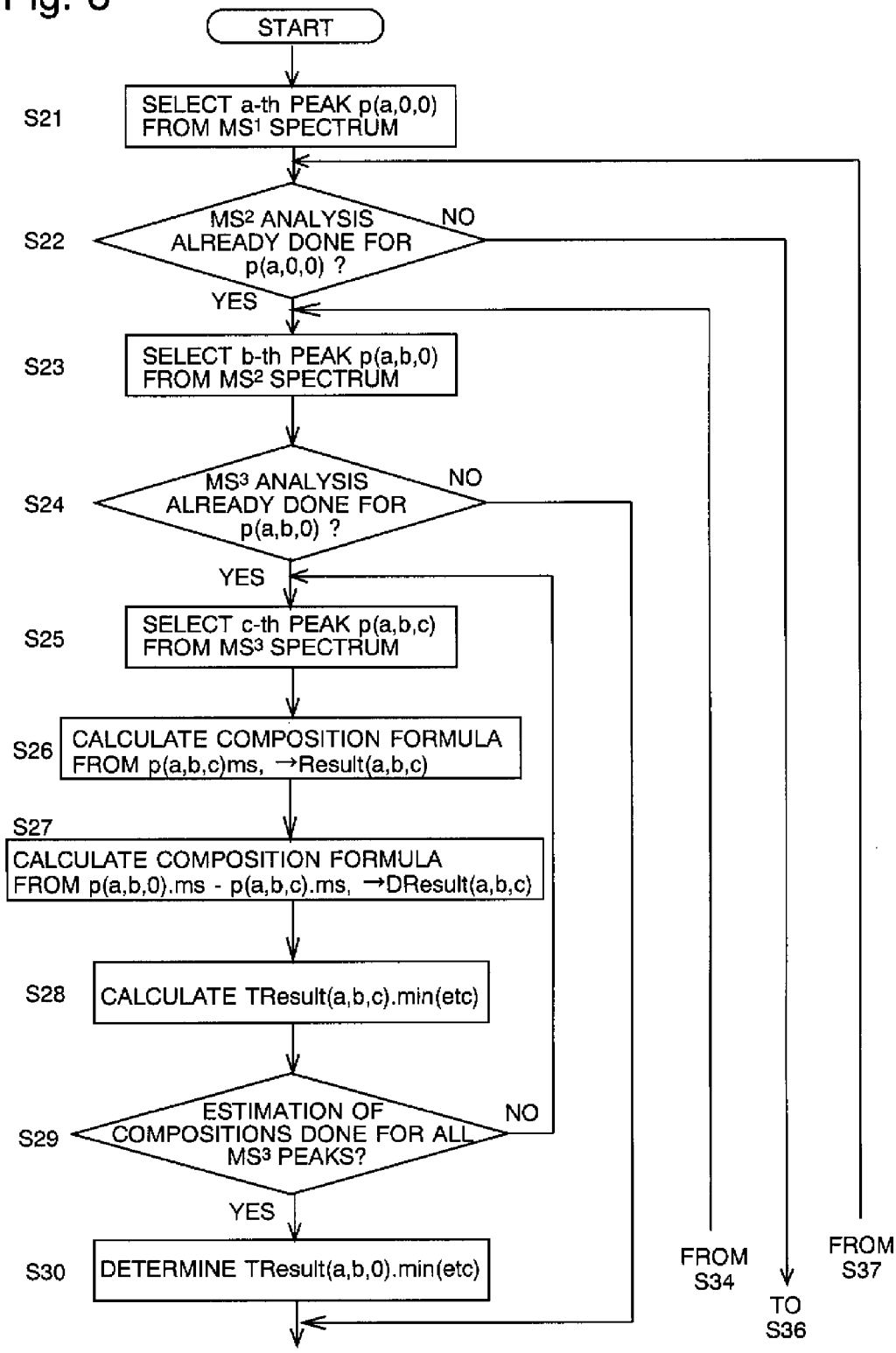
FIG. 3 is a flow chart showing another example of the first half (Step S21 to S30) of the characteristic steps of the analysis process using the mass spectrometer according the present embodiment.

Another example of the analysis process by the mass spectrometer of the present invention is described with reference to the flow chart shown in FIGS. 3 and 4. In the process shown in FIGS. 3 and 4, the sample to be analyzed is subjected to an $MS^1$ analysis in which no dissociating operation is performed, which is followed by an $MS^2$ analysis and an $MS^3$ analysis, and the composition of the component corresponding to the precursor ion (or the original sample) is estimated from the results of those analyses. The repetition count of the dissociating operation can be set at a value desired by the user, or the dissociating operation can be automatically repeated until the number of the candidates Y of the composition formula of the fragment ion is reduced to a predetermined value or smaller, as in the previously described analysis process.

In the following description, 1max, 2max and 3max each denote the number of peaks included in each of the three spectrums obtained by the $MS^1$, $MS^2$ and $MS^3$ analyses, and each peak included in each spectrum is identified by a code using parameters indicating the kind (or the order of dissociation) of the spectrum and the serial number of the peak within the spectrum. For example, the a-th peak in the $MS^1$ spectrum is denoted by p(a,0,0), the b-th peak of the spectrum obtained by the $MS^2$ analysis of the peak p(a,0,0) is denoted by p(a,b,0), and the c-th peak of the spectrum obtained by the $MS^3$ analysis of the peak p(a,b,0) is denoted by p(a,b,c).

In advance of the analysis, a condition table T is created and stored into the condition data storage unit 7, with other analysis conditions (e.g. the mass accuracy of the mass spectrometer). The condition table T shows the kinds of atoms that can be contained in the precursor ion originating from the sample and the maximum and minimum numbers of each kind of atoms: TResult(a0,0)max(etc) and TResult(a,0,0).min(etc) (the meanings of these expressions will be explained later). This table T can be manually prepared by the user or automatically created in response to a specific operation for setting the kinds of the sample and other parametric values. Subsequently, the $MS^1$ to $MS^3$ analyses are carried out, followed by the compositional analysis based on the results of those analyses.

When the analysis is started according to an instruction from the user, the data processor 5 selects the peak p(a,0,0) of the target ion (i.e. the precursor ion) from all the peaks present in the $MS^1$ spectrum (Step S21).

In the next step, it is checked whether the $MS^2$ analysis has been performed on the selected peak (Step S22). If the $MS^2$ analysis has been performed, the peak p(a,b,0) is selected from all the peaks present in the $MS^2$ spectrum according to predetermined criteria (e.g. the serial number or height of the peak) (Step S23). If the $MS^2$ analysis has not been performed on the peak p(a,0,0), the process goes to Step S36, which will be described later.

Subsequently, it is checked whether the $MS^3$ analysis has been performed on the peak p(a,b,0) (Step S24). If the $MS^3$ analysis has been performed, the peak p(a,b,c) is selected from all the peaks present in the $MS^3$ spectrum according to predetermined criteria (Step S25). If the $MS^2$ analysis has not been performed on the peak p(a,b,0), the process goes to Step S31, which will be described later.

In the next step, the candidates $Y_3$ of the composition formula of the fragment ion p(a,b,c) obtained in the $MS^3$ analysis are calculated on the mass, with reference to the database 6 (Step S26). This calculation narrows down the candidates $Y_3$ by taking into account the analysis conditions including the maximum number of each kind of atoms (TResult(a,0,0).max(etc)) and the mass accuracy shown in the condition table T. The result of the compositional calculation, which is expressed as Result(a,b,c), is obtained in the form a list of the candidate composition formulae $Y_3$. In this list, the minimum number of the atom of each element, i.e. the smallest possible number of the atoms of each element contained in the fragment ion p(a,b,c), is expressed as Result(a,b,c).min(etc), where "etc" denotes an unspecified element. For example, the minimum numbers of carbon (C) and hydrogen (H) atoms contained in the ion corresponding to p(a,b,c) are expressed as Result(a,b,c).minC and Result(a,b,c).minH, respectively.

Next, the difference between the mass of the peak p(a,b,c) and that of the peak p(a,b,0) of the fragment ion found in the $MS^2$ spectrum, which corresponds to the precursor ion of the peak p(a,b,c), is calculated. The two masses are expressed as p(a,b,c).ms and p(a,b,0).ms, respectively. Then, with reference to the database 6, the candidate composition formulae $Z_3$ of the desorption ion corresponding to the difference between the two masses (=p(a,b,0).ms−p(a,b,c).ms) are calculated. The result of this calculation is expressed as DResult(a,b,c)) (Step S27). As in the previous step, the candidates $Z_3$ are narrowed down by taking into account the maximum number of each kind of atoms and the mass accuracy as the analysis conditions, where the maximum number of each kind of atoms is calculated by TResult(a,0,0).max(etc)−Result(a,b,c).min(etc), i.e. by subtracting the lowest possible number of that kind of atoms contained in the fragment ion obtained in Step S26 from the maximum number of the same kind of atoms that can be contained in the precursor ion, as shown in the table T. This operation restricts the analysis conditions on the estimation of the desorption ion and thereby reduces the number of the candidates $Z_3$ to be obtained.

In the next step, the minimum number of each kind of atoms contained in the fragment ion obtained in Step S26, expressed as Result(a,b,c).min(etc), and the minimum number of each kind of atoms contained in the desorption ion obtained in Step S27, expressed as DResult(a,b,c).min(etc), are added (Step S28). The result of this calculation is denoted by TResult(a,b,c).min(etc)=Result(a,b,c).min(etc)+DResult (a,b,c).min(etc).

Then, it is checked whether Steps S25 to S28 have been performed for all the peaks p(a,b,c) found in the $MS^3$ spectrum (for c=1 to 3max) (Step S29). Steps S25 to S28 are repeated until all the peaks in the $MS^3$ spectrum are through the analysis.

In the next step, all the values of TResult(a,b,c).min(etc) (for c=1 to 3max) calculated for all the peaks in the $MS^3$ spectrum are examined and the largest value is chosen for each kind of atoms as TResult(a,b,0).min(etc), i.e. the smallest possible number of each kind of atoms contained in the ion corresponding to the peak p(a,b,0) in the $MS^2$ spectrum: e.g. TResult(a,b,0).minC, TResult(a,b,0).minH and TResult(a,b,0).minO. The values hereby chosen are written into the condition table T (Step S30).

Thus, the analysis based on the peaks p(a,b,c) in the $MS^3$ spectrum (for c=1 to 3max) is finished and the analysis conditions are determined for calculating the candidate compositions $X_2$ of the fragment ion (denoted by p(a,b,0)) in the $MS^2$ spectrum, which corresponds to the precursor ion for the aforementioned peaks p(a,b,c). The next step is to determine the candidate composition formulae $X_2$ of the peak p(a,b,0) on the basis of its mass (p(a,b,0).ms) (Step S31). In this step, the values of TResult(a,0,0).max(etc) written into the condition table T at the beginning of the analysis and the values of TResult(a,b,0).min(etc) added to the condition table T in Step S30 are used as the maximum and minimum numbers of each kind of atoms contained in the candidates $X_2$. The result obtained in Step S31 is expressed as Result(a,b,0).

The next step is to calculate the difference between the mass of the peak p(a,b,0) and that of the peak p(a,0,0) of the precursor ion in the $MS^1$ spectrum, which corresponds to the precursor ion for the peak p(a,b,0), and to calculate the candidate composition formulae $Z_2$ of the desorption ion corresponding to the mass difference (p(a,0,0).ms−p(a,b,0).ms) (Step S32). In the analysis conditions used in this calculation, the maximum number of each kind of atoms is calculated by TResult(a,0,0).max(etc)−Result(a,b,0).min(etc), or by subtracting the minimum number of that kind of atoms contained in the candidates $X_2$ obtained in Step S31 from the maximum number of the same atoms that can be contained in the precursor ion, as shown in the condition table T.

Next, similar to Step S28, the minimum number of each kind of atoms contained in the fragment ion, expressed as Result(a,b,0), and the minimum number of the same atom contained in the desorption ion, expressed as DResult(a,b,0), are added to obtain TResult(a,b,0).min(etc) (Step S33).

Subsequently, it is checked whether Steps S23 to S33 have been performed for all the peaks p(a,b,0) in the $MS^2$ spectrum (for b=1 to 2max) (Step S34). Steps S23 to S33 are repeated until all the peaks in the $MS^2$ spectrum are through the analysis. Then, all the values of TResult(a,b,0).min(etc) (for b=1 to 2max) calculated for all the peaks are examined and the largest value is chosen for each kind of atoms as TResult(a,0,0).min(etc), i.e. the smallest possible number of each kind of atoms contained in the ion corresponding to the peak p(a,0,0), i.e. the precursor ion. The values hereby chosen are written into the condition table T (Step S35).

Thus, the analysis based on the peaks p(a,b,0) in the $MS^2$ spectrum (for b=1 to 2max) is finished and the analysis conditions are determined for calculating the candidate compositions $X_1$ of the precursor ion (denoted by p(a,b,0)) in the $MS^1$ spectrum, which corresponds to the precursor ion for the aforementioned peaks p(a,b,0). The next step is to determine the candidate composition formulae $X_1$ of the precursor ion on the basis of its mass of p(a,0,0) (Step S36). In this step, the values of TResult(a,0,0).max(etc) written into the analysis condition table T at the beginning of the analysis and the values of TResult(a,0,0).min(etc) written into the analysis condition table in Step S35 are used as the maximum and minimum numbers of each kind of atoms contained in the candidates $X_1$. The result obtained in Step S36 is expressed as Result(a,0,0).

In the next step, the value of Result(a,0,0) obtained in Step S36 is evaluated on the basis of predetermined criteria in order to determine whether it is necessary to re-estimate the composition (Step S37). For example, the analysis may be restarted if Result(a,0,0) includes more candidates $X_1$ than predetermined or discontinued when the number of the candidates $X_1$ has become smaller than predetermined or when the repetition of the analysis no longer changes the number of the candidates $X_1$.

In Step S37, if it is determined that it is necessary to re-estimate the composition, the minimum and maximum numbers of each kind of atoms contained in the precursor ion is derived from Result(a,0,0) and then the values of TResult (a,0,0).min(etc) and TResult(a,0,0).max(etc) shown in the condition table T for each kind of atoms are updated with those derived values. After that, the process returns to Step S22 to follow Steps S22 to S36 again. In Step S37, if it is determined that it is no longer necessary to repeat the analysis, the candidate composition formulae $X_1$ obtained in Step S36 are adopted as the final candidates (Step S38), where the isotopic distribution and the nitrogen rule should be also considered.

In the analysis process described thus far, the results of analysis of the fragment ion and the desorption ion produced by dissociating a precursor ion are used to determine the minimum number of each kind of atoms contained in the precursor ion. These minimum numbers are used to restrict the conditions for estimating the composition of the precursor ion and thereby reduce the number of candidates to be derived by the compositional calculation. Since the data of all the peaks found in the $MS^2$ and $MS^3$ spectrums are used to determine the analysis conditions, the analysis can be performed with higher accuracy.

Figure 4:
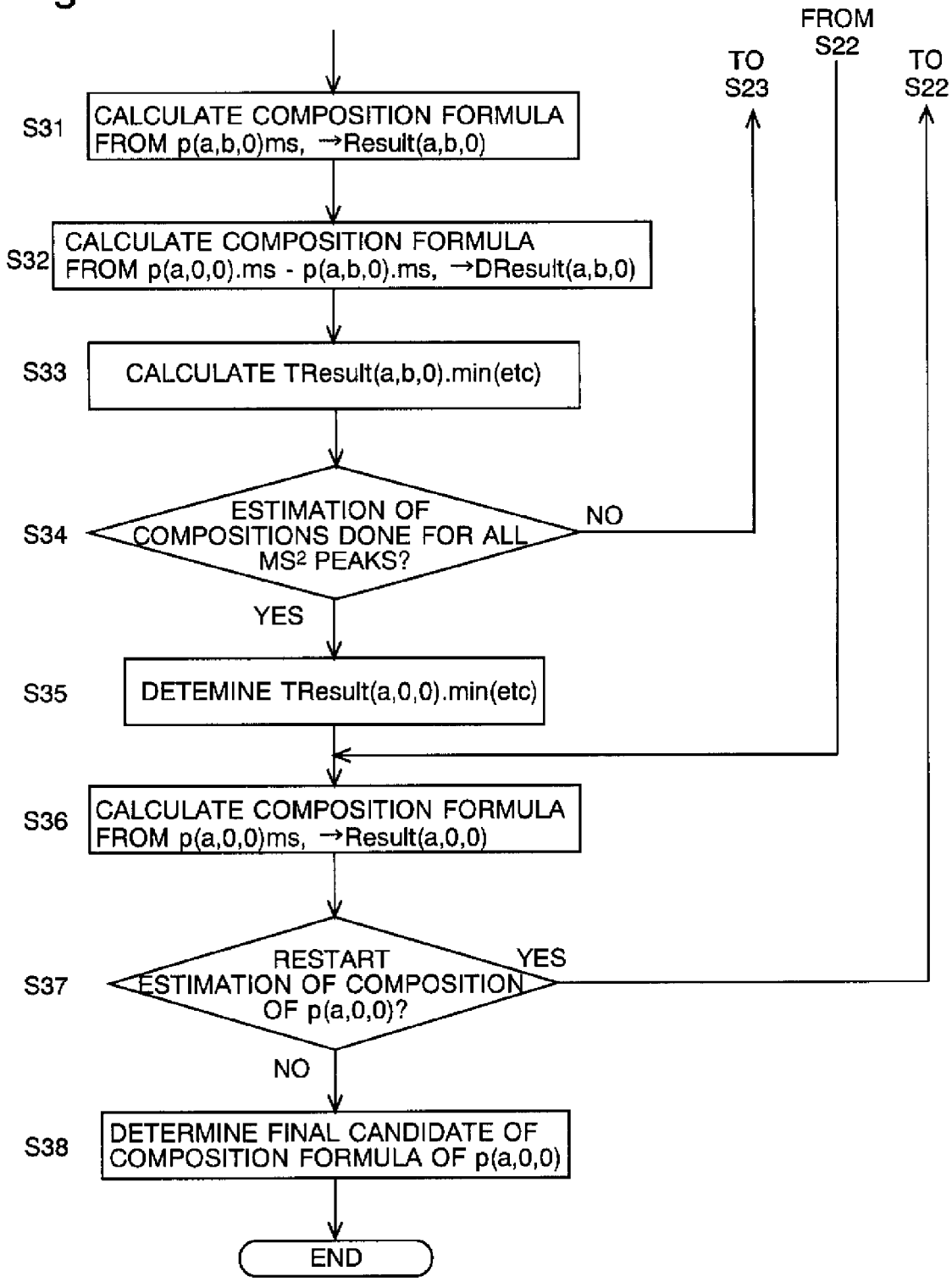
FIG. 4 is the second half (Steps S31 to S38) of the same flow chart.

In the compositional estimation in Step S31 or S36 of the analysis process shown in FIG. 4, it is preferable to narrow down the candidates X by using the candidates Y and Z of the fragment and desorption ions produced by dissociating the ion, as in analysis process explainer earlier.

EMBODIMENT 1

Estimating the composition of the sample according to the flow chart of FIG. 2 facilitates the narrowing down of the candidate composition formulae of the precursor ion, as can be seen in the following example.

Figure 5:
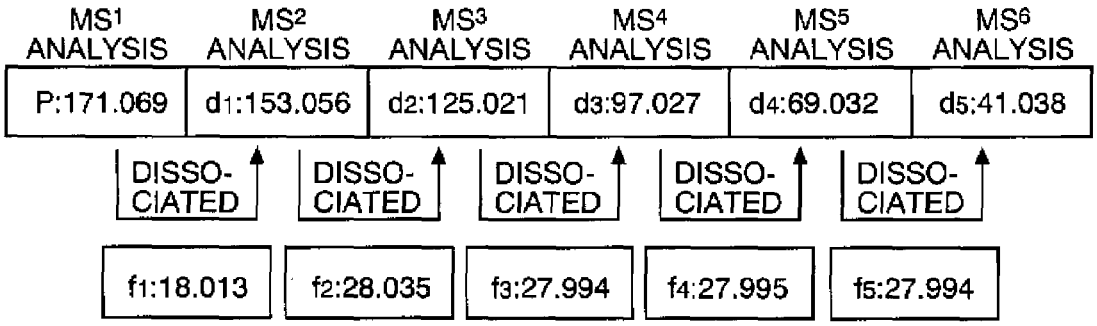
FIG. 5 is a schematic diagram showing an example of the analysis process according to the flow chart of FIG. 2.

Suppose that the mass P of the precursor ion created by ionizing a target sample is P=171.066 (u: atomic mass unit) is subjected to a dissociating process in which the precursor ion is dissociated into the following five kinds of fragment ions by carrying out the dissociating operation five times: $d_1$=153.056, $d_2$=125.021, $d_3$=97.027, $d_4$=69.032 and $d_5$=41.038. In this case, the differences $f_m$ between the mass of the precursor or fragment ion in the $MS^{n-1}$ analysis and that of the fragment ion in the $MS^n$ analysis will be as shown in FIG. 5.

Now, suppose that the kinds and maximum numbers of the atoms are as follows: 14 atoms of carbon (C), 30 atoms of hydrogen (H), 10 atoms of oxygen (O) and 10 atoms of nitrogen (N), and that the mass accuracy is 0.02 u. Under these analysis conditions, the candidates of the composition formula deduced from the result of the $MS^1$ analysis, or from the mass P of the precursor ion, will be as shown in Table 1.

TABLE 1

| # | Mass | Diff. | Formula |
|---|---|---|---|
| 1 | 171.068 | 0.001 | $C_{11}H_9NO$ |
| 2 | 171.067 | 0.002 | $C_9H_7N_4$ |
| 3 | 171.072 | 0.003 | $H_9N_7O_4$ |
| . | . | . | . |
| . | . | . | . |
| . | . | . | . |
| 27 | 171.049 | 0.020 | $CH_3N_{10}O$ |

This table lists a large number of candidate composition formulae X. If the mass accuracy were as high as 0.001, the candidate #1 in Table 1, whose [Diff] value is 0.001, could be chosen as the only candidate. However, the mass accuracies of mass spectrometers actually used cannot exceed ppm levels. Therefore, it is inevitable to have many candidates listed, as in the above case.

Under the same analysis conditions, the candidate composition formulae deduced from the results of the $MS^2$ analysis, or from the mass $d_1$ of the fragment ion obtained after the dissociating operation is performed one time, will be as shown in Table 2.

TABLE 2

| # | Mass | Diff. | Formula |
|---|---|---|---|
| 1 | 153.055 | 0.001 | $C_8H_9O_3$ |
| 2 | 153.058 | 0.002 | $C_{11}H_7N$ |
| 3 | 153.054 | 0.002 | $C_6H_7N_3O_2$ |
| . | . | . | . |
| . | . | . | . |
| . | . | . | . |
| 24 | 153.075 | 0.019 | $C_3H_{11}N_3O_4$ |

Even in this table, there are approximately as many candidates as deduced from the mass P of the precursor ion. Therefore, it is difficult to determine the composition formula.

After the dissociating operation is performed five times, the candidate composition formulae similarly deduced from the mass $d_5$ of the fragment ion will be as shown in Table 3, which lists only two candidates, a remarkable decrease in the number of the candidates.

TABLE 3

| # | Mass | Diff. | Formula |
|---|---|---|---|
| 1 | 41.039 | 0.001 | $C_3H_5$ |
| 2 | 41.027 | 0.011 | $C_2H_3N$ |

This is because the mass $d_5$ of the fragment ion obtained after the repetition of the dissociating operation is much smaller than the mass P of the precursor ion. The candidates of the desorption ion deduced from the mass differences $f_3$, $f_4$ and $f_5$, whose values are approximate to each other, are as shown in Table 4.

TABLE 4

| # | Mass | Diff. | Formula |
|---|---|---|---|
| 1 | 27.995 | 0.001 | CO |
| 2 | 28.006 | 0.012 | $N_2$ |

From generally known facts, it is almost impossible that $N_2$ is produced as a desorption ion in the dissociating process. Using such information supported by general knowledge, it possible to automatically exclude $N_2$ from the candidate composition formulae of the desorption ion. Thus, CO can be chosen as the most probable candidate.

Tables 5 and 6 show the candidates of the desorption ion deduced from the mass differences $f_2$ and $f_1$, respectively.

TABLE 5

| # | Mass | Diff. | Formula |
|---|---|---|---|
| 1 | 28.031 | 0.004 | $C_2H_4$ |
| 2 | 28.019 | 0.016 | $CH_2N$ |

TABLE 6

| # | Mass | Diff. | Formula |
|---|---|---|---|
| 1 | 18.011 | 0.000 | $H_2O$ |

Figure 2:
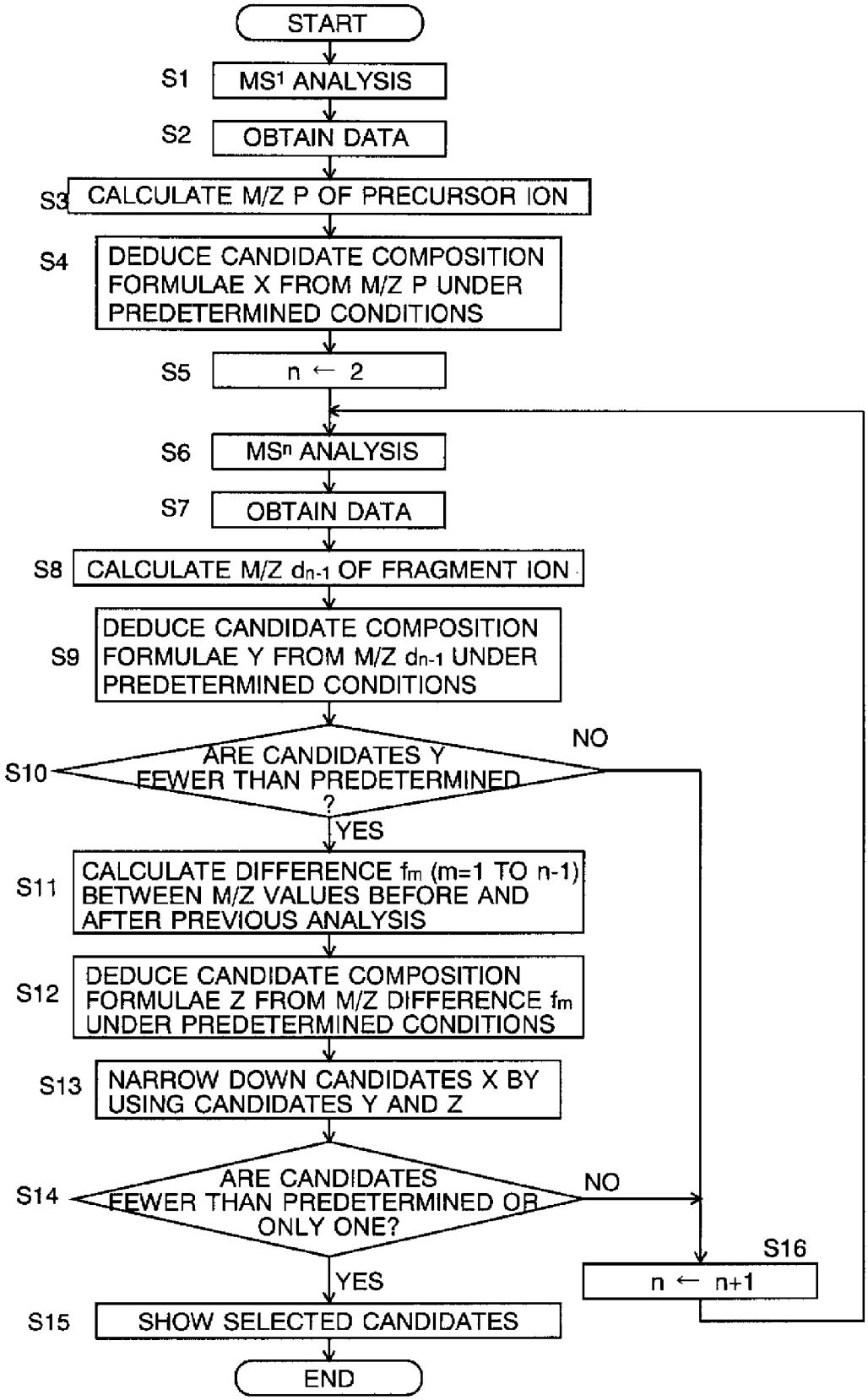
FIG. 2 is a flow chart showing an example of the characteristic steps of the analysis process using the mass spectrometer according the present embodiment.

In the flow chart shown in FIG. 2, if the predetermined value used in Step S10 is two or three, the determination result of Step S10 will be "Yes" after the $MS^6$ analysis is carried out. Subsequently, the mass differences $f_1$ to $f_5$ are calculated, from each of which the candidates of the desorption ion are deduced as explained above. The candidates shown in Table 3 correspond to the candidates Y in FIG. 2, and the candidates shown in Tables 4, 5 and 6 correspond to the candidates Z. From these results, the possible candidates of the precursor ion are:

$$(C_3H_5 \text{ or } C_2H_3N)+CO+CO+CO+(C_2H_2 \text{ or } CH_2N)+H_2O = C_8H_{11}O_4 \text{ or } C_7H_9NO_4 \text{ or } C_6H_7N_2O_4.$$

The number of the candidates has been reduced from the initial value of 27 to three. This reduced set of candidates is shown on a display screen or similar device. Thus, the person in charge of the analysis can obtain important information for finally determining the composition.

Though not carried out in the present embodiment, it is possible to check whether the final result deduced as described above is consistent with the candidate compositions of the fragment ion obtained in $MS^n$ analyses in which the result in Step S10 was "No", in order to improve the reliability of the final result or further narrow down the candidates.

EMBODIMENT 2

This section describes a specific example of the steps of narrowing down the candidate composition formulae of the precursor ion by using combinations of the candidate composition formulae of the fragment ion and that of the desorption ion in the mass-analyzing method according to the second mode of the present invention.

Suppose that the mass P of the precursor ion produced by ionizing the target ion is 150.01 (u) and the mass $d_1$ of the fragment ion produced by dissociating the precursor ion one time is 100.0 (u). The difference $f_1$ between the mass of the precursor ion and that of the fragment ion is $P-d_1=50.01$ (u). Now, let CF(P), CF($d_1$) and CF($P-d_1$) denote the candidate compositions of the precursor ion, fragment ion and desorption ion, respectively, and CF($d_1$)*CF($P-d_1$) denote the combinations of the candidate composition formulae CF($d_1$) of the fragment ion and the candidate composition formulae CF($P-d_1$) of the desorption ion.

Furthermore, the following conditions are hereby considered: the permissible error of P and $d_1$ is 0.003 (u) and that of $P-d_1$ is 0.06 (u); and the kinds of atoms and the maximum and minimum numbers of each kind of atoms are as shown in Table 7. Under these analysis conditions, one or more candidate composition formulae consistent with each of the masses P, $d_1$ and $P-d_1$ are deduced. In this deduction process, any candidate whose chemical bond number is unnatural with respect to the number of valence electrons should be excluded from consideration.

TABLE 7

| ELEMENTS | MIN. NR. | MAX. NR. |
|---|---|---|
| H | 0 | 21 |
| C | 0 | 14 |
| N | 0 | 8 |
| O | 0 | 5 |
| S | 0 | 2 |

The candidate composition formulae CF(P), CF($d_1$) and CF($P-d_1$) deduced under the above-described conditions are as shown in Tables 8, 9 and 10, respectively.

TABLE 8

| # | Mass | Diff. | Formula |
|---|---|---|---|
| 1 | 150.0099 | 0.00009 | $C_3H_6N_2O_3S$ |
| 2 | 150.0106 | 0.00056 | $C_{11}H_2O$ |
| 3 | 150.0092 | 0.00078 | $C_9N_3$ |
| 4 | 150.0086 | 0.00143 | $CH_4N_5O_2S$ |
| 5 | 150.0126 | 0.00259 | $C_6H_4N_3S$ |

TABLE 9

| # | Mass | Diff. | Formula |
|---|---|---|---|
| 1 | 99.9983 | 0.00171 | $C_4H_4OS$ |
| 2 | 100.0021 | 0.00213 | $CN_4O_2$ |

TABLE 10

| # | Mass | Diff. | Formula |
|---|---|---|---|
| 1 | 50.0064 | 0.00356 | $H_4NS$ |
| 2 | 50.0157 | 0.00565 | $C_4H_2$ |

From Tables 9 and 10, CF($d_1$)*CF($P-d_1$) can be obtained as follows:

$C_4H_8NOS_2$, $C_8H_6OS$, $CH_4N_5O_2S$ and $C_5H_2N_4O_2$.

Among these candidates, there is only one composition formula commonly found in both CF($d_1$)*CF($P-d_1$) and CF(P) shown in Table 8. $C_8H_6OS$. Therefore, this formula can be chosen as the final candidate composition formula for the precursor ion.

Finally, it should be noted that the embodiments described thus far are mere examples, which can be changed modified or expanded within the spirit of the present invention, whose scope is clearly stated in the Claims section of the present patent application.

The invention claimed is:

1. A mass-analyzing method for analyzing a molecular structure and/or composition of a sample, using a mass spectrometer capable of an $MS^n$ analysis in which a precursor ion originating from a sample to be analyzed is dissociated into fragment ions by (n−1) steps (where n≧3) and then the fragment ions are subjected to a mass-analyzing process, which is characterized in that it comprises:

a) a candidate X deduction step for deducing candidates X of a component corresponding to the precursor ion obtained by an $MS^1$ analysis in which no dissociating operation is performed, on a basis of a mass of the precursor ion;

b) a candidate Y deduction step for deducing candidates Y of a component corresponding to the fragment ion obtained by an $MS^m$ analysis (where 2≦m≦n), on a basis of a mass of that fragment ion;

c) a candidate Z deduction step to be performed when a number of the candidates Y is equal to or smaller than a predetermined value, where the step includes sub-steps of calculating a difference between the mass of the fragment ion obtained by an $MS^p$ analysis (for p=2 to m) and the mass of a precursor or fragment ion obtained by an $MS^{p-1}$ analysis and then deducing candidates Z of a component corresponding to the aforementioned difference in mass; and d) a narrowing step for narrowing down the candidates X by using at least the candidates Y and Z, and the number m is increased step by step from 2 up to n until the number of the candidates X becomes equal to one, or equal to or smaller than a predetermined value.

2. The mass-analyzing method according to claim 1, which is characterized in that, when m is at a certain value, if the number of the candidates Y in the candidate Y deduction step is larger than a predetermined value, the value of m is increased and then the candidate Y deduction step is carried out without performing the candidate Z deduction step and the narrowing step.

3. A mass-analyzing method for analyzing a molecular structure and/or composition of a sample, using a mass spectrometer capable of an $MS^n$ analysis in which a precursor ion originating from a sample to be analyzed is dissociated into fragment ions by (n−1) steps (where n≧2) and then the fragment ions are subjected to a mass-analyzing process, which is characterized in that it comprises:

a) a step for deducing candidate compositions X of a component corresponding to a precursor or fragment ion obtained by an $MS^m$ analysis (where 1≦m≦n−1), on a basis of a mass of the precursor or fragment ion;

b) a candidate Y deduction step for deducing candidates Y of a component corresponding to the fragment ion obtained by an $MS^p$ analysis (where p≧m+1) in which the aforementioned precursor or fragment ion is dissociated once or multiple times, on a basis of a mass of the fragment ion;

c) a candidate Z deduction step including sub-steps of calculating a difference between the mass of the fragment ion obtained by an $MS^q$ analysis (for q=m+1 to p) and the mass of the precursor or fragment ion obtained by an $MS^{q-1}$ analysis and then deducing candidates Z of a component corresponding to the aforementioned difference in the mass;

d) a candidate Y+X creation step for creating compound candidates Y+Z, each of which consists of one candidate Y combined with one candidate Z; and e) a narrowing step for narrowing down the candidates X by comparing the candidates X and the compound candidates Y+Z.

4. A mass-analyzing method for analyzing the molecular structure and/or composition of a sample, using a mass spectrometer capable of an $MS^n$ analysis in which a precursor ion originating from a sample to be analyzed is dissociated into fragment ions by (n−1) steps (where $n \geqq 2$) and then the fragment ions are subjected to a mass-analyzing process, which is characterized in that it comprises:

a) an analysis condition table creation step for creating an analysis condition table showing maximum and minimum numbers of each kind of atoms that can be contained in the precursor ion;

b) a candidate Y deduction step for deducing candidates Y of a component corresponding to the fragment ion obtained by an $MS^m$ analysis (where $2 \leqq m \leqq n$), on a basis of a mass of that fragment ion;

c) a candidate Z deduction step including sub-steps of calculating a difference between a mass of an ion obtained by an $MS^{m-1}$ analysis, which ion corresponds to a precursor ion for a fragment ion, and a mass of that fragment ion, and then deducing candidates Z of a component corresponding to the aforementioned difference in the mass;

d) an analysis condition revision step A for increasing the minimum number of each kind of atoms shown in the analysis condition table, taking into account the minimum number of each kind of atoms contained in the candidates Y and Z; and e) a candidate X deduction step for deducing candidates of a component corresponding to the aforementioned precursor ion, on a basis of the mass of the precursor ion, where, in the candidate X deduction step, the candidates X are deduced under analysis conditions using the maximum and minimum numbers of each kind of atoms shown in the analysis condition table revised in the analysis condition revision step A.

5. The mass-analyzing method according to claim 4, which is characterized in that it comprises:

an analysis condition revision step B for subtracting the minimum number of each kind of atoms contained in the candidates Y from the maximum number of each kind of atoms that can be contained in the precursor ion, as shown in the aforementioned analysis condition table, where, in the candidate Z deduction step, the candidates Z are deduced under analysis conditions using the maximum number of each kind of atoms shown in the analysis condition table revised in the analysis condition revision step B.

6. The mass-analyzing method according to claim 4, which is characterized in that it comprises:

an analysis condition revision step C for subtracting the minimum number of each kind of atoms contained in the candidates Z from the maximum number of each kind of atoms that can be contained in the precursor ion, as shown in the aforementioned analysis condition table, where, in the candidate Y deduction step, the candidates Y are deduced under analysis conditions using the maximum number of each kind of atoms shown in the analysis condition table revised in the analysis condition revision step C.

7. The mass-analyzing method according to one of claims 4 to 6, which is characterized in that it comprises steps of:

increasing the minimum number of each kind of atoms shown in the analysis condition table and decreasing the maximum number of each kind of atoms, taking into account the minimum and maximum numbers of each atom contained in the candidates X of the component corresponding to the precursor ion deduced in the candidate X deduction step; and performing the steps b) to e) again, using the revised analysis condition table.

* * * * *